US005255804A

United States Patent [19]

Butterbrodt

[11] Patent Number: 5,255,804

[45] Date of Patent: Oct. 26, 1993

[54] TUBE OF TAMPERPROOF CONSTRUCTION AND PROCESS FOR MAKING SAME

[75] Inventor: Gerhard Butterbrodt, Berlin, Fed. Rep. of Germany

[73] Assignee: Schering Aktiengesellschaft, Berlin, Fed. Rep. of Germany

[21] Appl. No.: 793,448

[22] PCT Filed: Jan. 13, 1990

[86] PCT No.: PCT/DE90/00537

§ 371 Date: Jan. 14, 1992

§ 102(e) Date: Jan. 14, 1992

[87] PCT Pub. No.: WO91/01254

PCT Pub. Date: Feb. 7, 1991

[30] Foreign Application Priority Data

Jul. 14, 1989 [DE] Fed. Rep. of Germany ..... 3923799

[51] Int. Cl.[5] ..... B65D 1/02; B65D 41/62

[52] U.S. Cl. ..... 215/32; 215/226; 215/277

[58] Field of Search ..... 215/31, 32, 35, 226, 215/274, 277, 12.2

[56] References Cited

U.S. PATENT DOCUMENTS

| | | | |
|---|---|---|---|
| 3,544,020 | 12/1970 | Goldberg | 215/32 X |
| 3,749,271 | 7/1973 | Ellis, Jr. et al. | 215/32 |
| 3,784,045 | 1/1974 | Komendowski | 215/32 X |
| 4,134,511 | 1/1979 | Deussen | 215/32 |
| 4,176,755 | 12/1979 | Winchell | 215/32 |
| 4,207,990 | 6/1980 | Weiler et al. | 210/267 |
| 4,319,701 | 3/1982 | Cambio . | |
| 4,353,869 | 10/1982 | Guth | 215/32 X |
| 4,392,576 | 7/1983 | Berger et al. | 215/1 C |
| 4,405,053 | 9/1983 | Cherot | 215/32 |
| 4,478,342 | 10/1984 | Slater et al. | 215/32 |
| 4,598,839 | 7/1986 | Dombroski et al. . | |
| 4,688,703 | 8/1987 | Bayer | 215/32 X |
| 4,773,548 | 9/1988 | Deussen | 215/32 X |
| 4,826,025 | 5/1989 | Abiko et al. | 215/32 |

FOREIGN PATENT DOCUMENTS

| | | |
|---|---|---|
| 2653993 | 6/1978 | Fed. Rep. of Germany . |
| 8632961 | 3/1987 | Fed. Rep. of Germany . |
| 1444848 | 8/1976 | United Kingdom . |
| 2039267 | 8/1980 | United Kingdom . |

*Primary Examiner*—Gary E. Elkins
*Assistant Examiner*—Vanessa Caretto
*Attorney, Agent, or Firm*—Millen, White, Zelano & Branigan

[57] ABSTRACT

A tamperproof closure for a tube includes a neck projection on a neck of the tube, which neck projection is riveted to an edge of a sleeve section provided in a cap. After the neck projection has been broken off to use the tube, the cap can be replaced on the tube, however, the connection is so loose that when the tube is picked up again, the cap is immediately detached from the neck, thus indicating prior use.

6 Claims, 2 Drawing Sheets

TUBE OF TAMPERPROOF CONSTRUCTION AND PROCESS FOR MAKING SAME

BACKGROUND OF THE INVENTION

1. Field of the Invention

This invention relates to a tamperproof closure for a tube containing liquid, pasty or powdery material, especially pharmaceutical agents, on whose neck is molded a breakoff neck projection closing an output opening, which is engaged nonpositively or positively with a slipped-on cap.

2. Background Considerations

A container with a breakoff closure for receiving and metered dispensing of liquid, pasty or powdery material, for example, pharmaceutical agents, is known from DE-PS 26 53 993. With the known container, on the front end of the container neck a breakoff neck projection is molded with a preshaped recessed predetermined, breaking point to provide a tightly closed covering for the outlet opening. In addition, a cap that can be slipped on the front end of the neck is provided. After the first use, this container can again be closed with the cap, which is held to the container either by a locking engagement or a press fit. The manipulation of a second or other subsequent opening and the necessary expenditure of force are the same as in the first opening, so that the user cannot determine whether the container still has the original closure.

In the removal of certain materials, especially pharmaceutical agents, from containers, a tamperproof closure, i.e., a definite indication for the user that the container has not yet been opened, is often necessary.

SUMMARY OF THE INVENTION

The object of the invention is to make available a simple tamperproof closure for tubes of the above-described type.

According to the invention, this object is achieved by a tamperproof closure on a tube for liquid, pasty or powdery material, especially pharmaceutical agents, on whose neck is molded a breakoff neck projection closing an output opening, which is engaged nonpositively or positively with a slip-on cap, wherein after the filling and closing the tube a section of a neck projection or a projection formed on the latter is guided through an opening made in the cap, and is thereafter deformed to form a flange engaging over an edge of opening (6), The tube for liquid, pasty or powdery material, especially pharmaceutical agents, on whose neck is molded a breakoff neck projection closing an output opening, which is engaged nonpositively and positively with a slip-on cap includes a, cap that has an opening in the front and a neck projection that includes a section or projection projecting from the opening of the cap.

A positive connection between the neck projection of the tube and the cap slipped on the tube is advantageously produced by the process according to the invention. It is necessary only to make an opening on the front of the cap, i.e., to open the previously closed sleeve section of the cap, which receive the neck projection nonpositively or positively, and to guide a section of the neck projection or a projection formed on the latter through the opening thus resulting. Then, a deformation of this section or projection takes place to form a flange engaging over the edge of the opening. In this way, a positive connection is produced which resembles a rivet joint.

If the tube is opened by the breaking off of the neck projection, the cap can indeed be slipped again on the neck of the tube, but the neck immediately detaches from the tube neck. When grasped, so that the user knows that this tube had already been opened. This is important for sanitation purposes since the tube has for one of its uses anal application of pharmaceutical preparation.

Advantageously, a tube whose cap exhibits an opening in the front is used to perform the process. The sleeve section of the cap receiving the neck projection nonpositively or positively, is made as a sleeve open on both sides. The neck projection includes a section or projection projecting from this opening of the slip-on cap. In one embodiment, the neck projection is longer than the sleeve section on the cap receiving the neck projection. In another embodiment, a nipple-type projection is made on the neck projection, which extends through the opening of the slip-on cap.

It is especially advantageous to use the process according to the invention in tubes whose neck is designed as a rectal cannula. With these tubes, the tube body with special advantage consists of a laminate, especially an Al/PE laminate and has a molded-on or incorporated neck.

BRIEF DESCRIPTION OF THE DRAWINGS

An embodiment of the invention is to be explained with reference to the figures of the drawing. There are shown in:

FIG. 1*b*—a top view of a neck projection on the tube,

FIG. 2*b*—a top view of the cap of FIG. 2*a*,

DETAILED DESCRIPTION

Figure 2B:
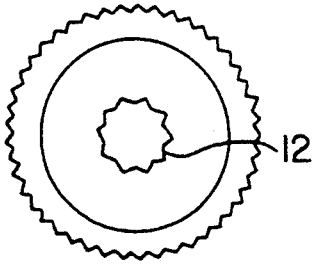
Figure 1B:
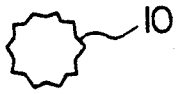
Figure 1A:
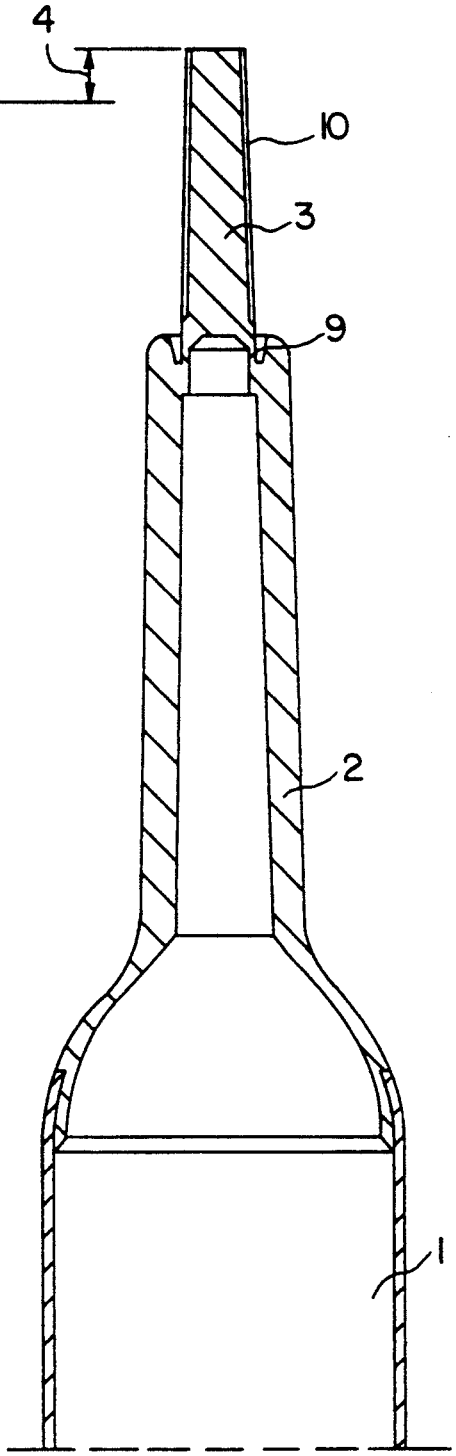
FIG. 1*a*—a side, sectional view of a tube.
Figure 1C:
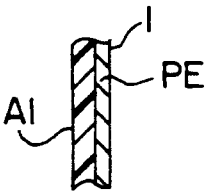
FIG. 1*c* is an enlarged portion of the tube wall shown in cross-section

A tube 1 is represented in FIG. 1*a*. This tube 1 consists of a laminate (FIG. 1*c*), especially of an Al/PE laminate. A neck 2 is incorporated in this tube in the represented embodiment. This neck 2 is designed as a rectal cannula.

A neck projection 3 is molded-on to form a predetermined breaking point or frangible 9 on neck 2. This neck projection 3 closes the mouth of neck 2 with the frangible. Neck portion 3 includes a toothin 10 made on its periphery.

Figure 2A:
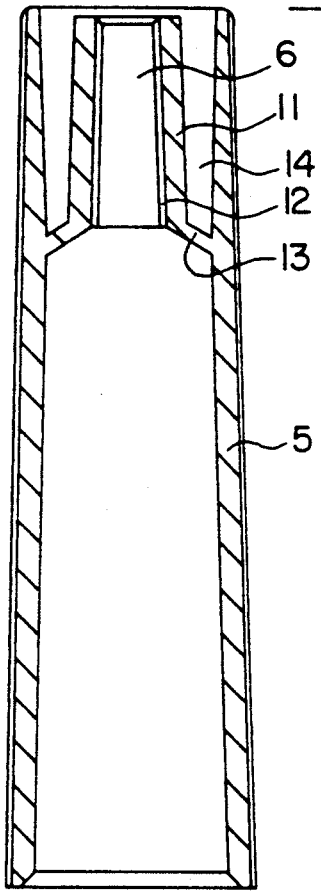
FIG. 2*a*—a side sectional view of a cap.

In FIG. 2*a* in addition to tube 1 represented in FIG. 1*a*, a cap 5 is represented relative to the tube at a level which the cap 5 occupies in the slipped-on position on tube 1.

Figure 3:
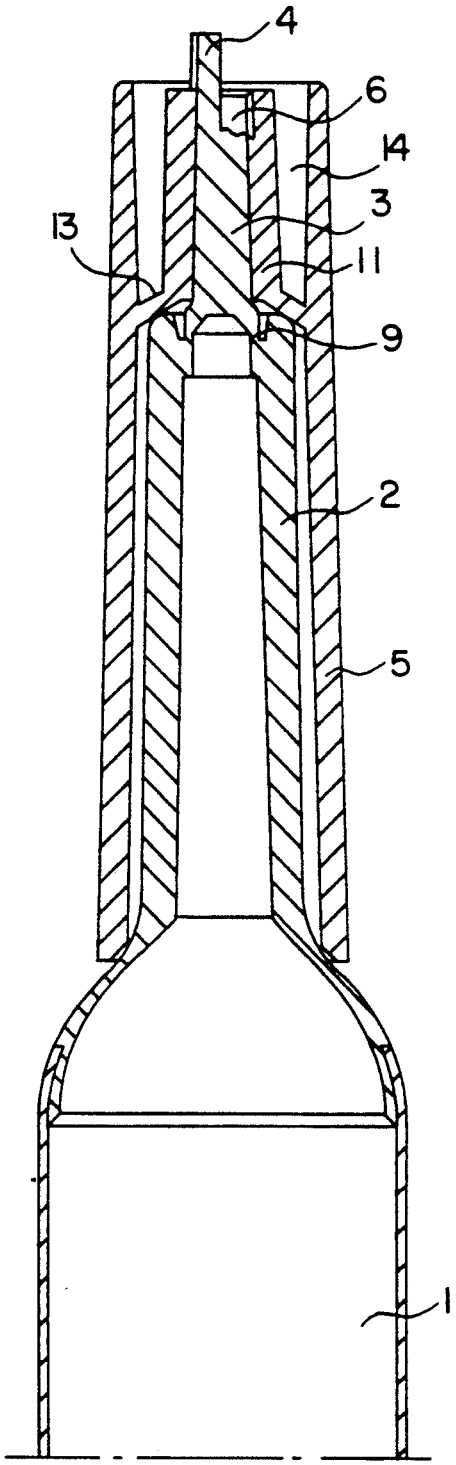
FIG. 3 a sectional view of a tube with a slipped-on cap, in which a part of the neck projection has been broken away, and FIG. 4 a tube with the tamperproof closure produced according to the invention.

Cap 5 includes a sleeve section 11, in which an inside toothing 12 is made. If, as FIG. 3 shows, cap 5 is slipped on neck 2 of tube 1, section 4, represented in FIG. 1*a* of neck projection 3 projects from opening 6 at the upper end of sleeve section 11. When cap 5 is slipped on neck 2, toothings 10 and 12 engage with one another, so that a positive, torsion-resistant connection is provided. The sleeve 11 is secured within the cap 5 by an annular flange 13 and is spaced from the cap by an annular gap 14.

Figure 4:
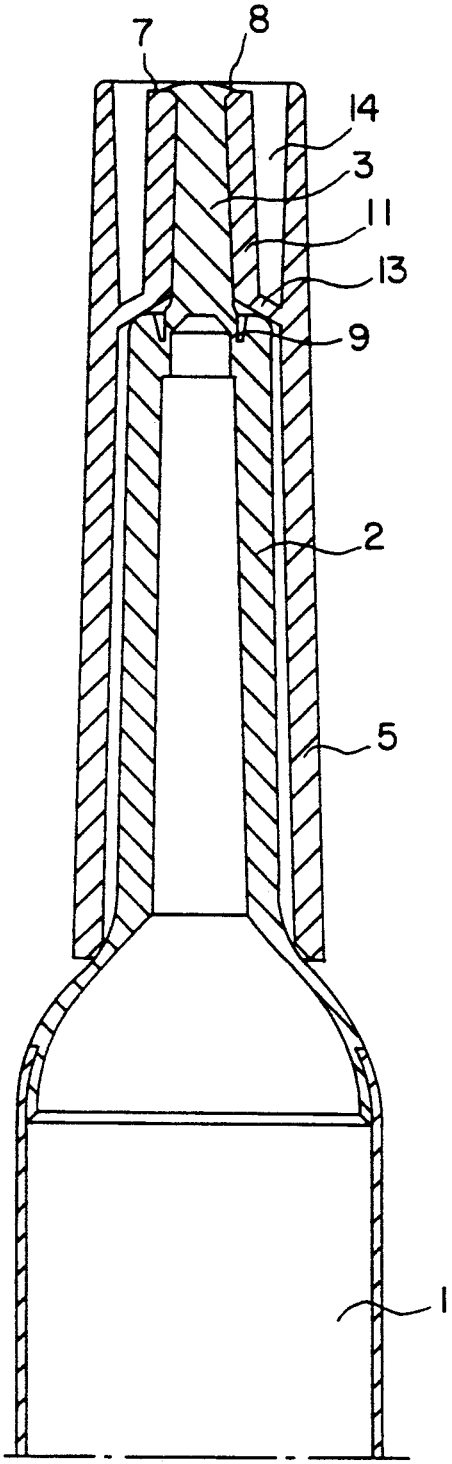

By a deformation of section 4 of neck projection 3 represented in FIGS. 1 and 3, flange 8 represented in FIG. 4, which engaged over edge 7 at opening 6 or on sleeve section 11, is formed. In this way, a rivet-type connection between cap 5 and neck 2 or neck projection 3 is produced. This rivet-type connection assures, on the one hand, a secure fit of cap 5 on tube 1, as long as tube 1 has never been opened. On the other hand, this rivet connection makes it possible to configure the fit of cap 5 on neck 2 so loose that after breaking open the tube by twisting off neck projection 3, cap 5 can again be slipped-on loosely on the neck. However, since the cap 5 is detachable immediately from the tube 1 in the case of an attempted reuse, an indication is given to the user or another person that tube 1 has already been opened once. This is an important sanitary consideration since a tube used by one patient should not be used by another.

I claim:

1. A tube useful for containing a flowable material, the tube having a neck on which is initially fixed a breakoff neck projection closing an output opening through the neck with a frangible connection when the tube is in an initial sealed configuration, the tube including a superimposed cap fitting over the neck; the cap including an interior with an internal sleeve fixed therein, the sleeve having an upper end and lower end and having an opening therethrough for receiving the breakoff neck projection, the breakoff neck projection having a portion projecting through and out of the upper end of the sleeve and being deformed over the upper end of the sleeve to secure the breakoff neck projection within the sleeve when the tube is in said initial sealed configuration, whereby when the cap is rotated, the breakoff neck projection is detached from the neck but the cap may be loosely mounted on the neck to surround the neck without being fixed thereto to provide an indication that the tube has been opened.

2. The tube of claim 1, wherein the sleeve is fixed to the interior of the cap by a web disposed at the lower end of the sleeve and wherein there is a space between the sleeve and the cap.

3. The tube of claim 1, wherein the breakoff neck portion has a scalloped outer surface which mates with a scalloped inner surface of the sleeve.

4. The tube of claim 1, wherein the neck is useful as a rectal cannula.

5. The tube of claim 1, wherein the tube has a body made of a laminate and wherein the neck is molded thereon.

6. The tube of claim 1, wherein the breakoff neck projection has a scalloped external and the sleeve has a scalloped internal surface which scalloped surfaces interengage when the tube is in the initial sealed configuration whereby the breakoff neck projection is rotated upon rotating the cap to fracture the connection between the breakoff neck projection and output opening.

* * * * *